United States Patent [19]

Bruno et al.

[11] 4,094,670

[45] June 13, 1978

[54] WEATHERING STEEL WITH HIGH TOUGHNESS

[75] Inventors: Roberto Bruno; Valerio Faccenda, both of Rome, Italy

[73] Assignee: Italsider S.p.A., Italy

[21] Appl. No.: 812,391

[22] Filed: Jul. 1, 1977

Related U.S. Application Data

[63] Continuation of Ser. No. 514,780, Oct. 15, 1974, abandoned.

[30] Foreign Application Priority Data

Oct. 15, 1973 Italy ..... 53141 A/73

[51] Int. Cl.[2] ..... C22C 38/06; C22C 38/16; C22C 38/20

[52] U.S. Cl. ..... 75/124; 75/125

[58] Field of Search ..... 75/124, 125, 126 C, 75/126 D, 126 F; 148/36

[56] References Cited

U.S. PATENT DOCUMENTS

| | | | |
|---|---|---|---|
| 2,679,454 | 5/1954 | Offenhauer | 75/124 |
| 2,901,346 | 8/1959 | Huddle et al. | 75/124 |
| 3,684,493 | 8/1972 | Kubota et al. | 75/125 |

*Primary Examiner*—Arthur J. Steiner
*Attorney, Agent, or Firm*—Young & Thompson

[57] ABSTRACT

A weathering steel has high toughness and rapidly develops a protective oxide coating and contains C 0.05 – 0.15, Mn 0.5 – 1.5, Cu 0.2 – 0.5, Al 0.2 – 0.5, Si 0.1 – 0.8, Cr 0.5 – 1.5, S up to 0.02, P up to 0.04, Nb up to 0.020, N up to 0.010 Mo up to 0.15, Ti up to 0.1, balance essentially iron, the proportions being as follows:

$2.6(Mn\%) + 3.2(Cu\%) + 41.6(Nb\%) + 1.3(Cr\%/Al\%) = 7.4$ to 10.1 the value of Cr%/Al% being from 2 to 5, preferably from 3 to 4.

2 Claims, 2 Drawing Figures

WEATHERING STEEL WITH HIGH TOUGHNESS

This is a continuation, of application Ser. No. 514,780, filed Oct. 15, 1974, now abandoned.

The present invention relates to weathering steels, that is, to steels which develop a thin film of oxide that protects the underlying metals from further oxidation and thus develop their own protective coating and need no other.

Such weathering steels are already known, as are the advantages inherent in their use. Weathering steels have higher mechanical properties than do plain carbon steels and thus permit lighter constructions. They do not need to be painted for protection against corrosion and so do not require maintenance after erection. Thus, after simple sand-blasting to remove grease stains, oil and any markings of paint or chalk, and after exposure for a certain time to the atmosphere, a thin film of oxide forms on the surface of these steels, which is compact and adherent and protects the underlying metal from further oxidation. The thickness of the metal oxidized in the formation of this layer is generally less than 0.1 mm, and the time required for the formation of this protective film as well as for its chemical and physical stabilization is between two and four years.

These characteristics make the use of weathering steels attractive from an economic point of view, despite their higher cost as compared to a corresponding plain carbon steel. Nevertheless, weathering steels have the following drawbacks:

1. The exposed surface takes too long to reach its final appearance which, in any event, is not necessarily attractive in appearance because it looks rusty.
2. The toughness of these steels is not dependably reproducible, and this limits them to uses which are mostly decorative despite the possibly unattractive appearance mentioned above.

Thus the suppliers of weathering steels ordinarily will not guarantee a Charpy — V impact strength of more than 3.5 kg m/cm$^2$ at the required temperature. Even this, however, is an additional property over and above the standard and so adds an extra cost to the material which is already fairly costly even when complying with lower specifications.

Accordingly, it is an object of the present invention to provide the weathering steel with high toughness and particularly a non-stainless steel having reliably reproducible high impact strength even at low temperatures, high tensile strength and good weldability and workability.

Another object of the present invention is the provision of a weathering steel that has no need of painting or other surface protection against atmospheric corrosion, and which has an improved tendency toward the formation of a protective oxide coating or patina as compared to known weathering steels.

Figure 1:
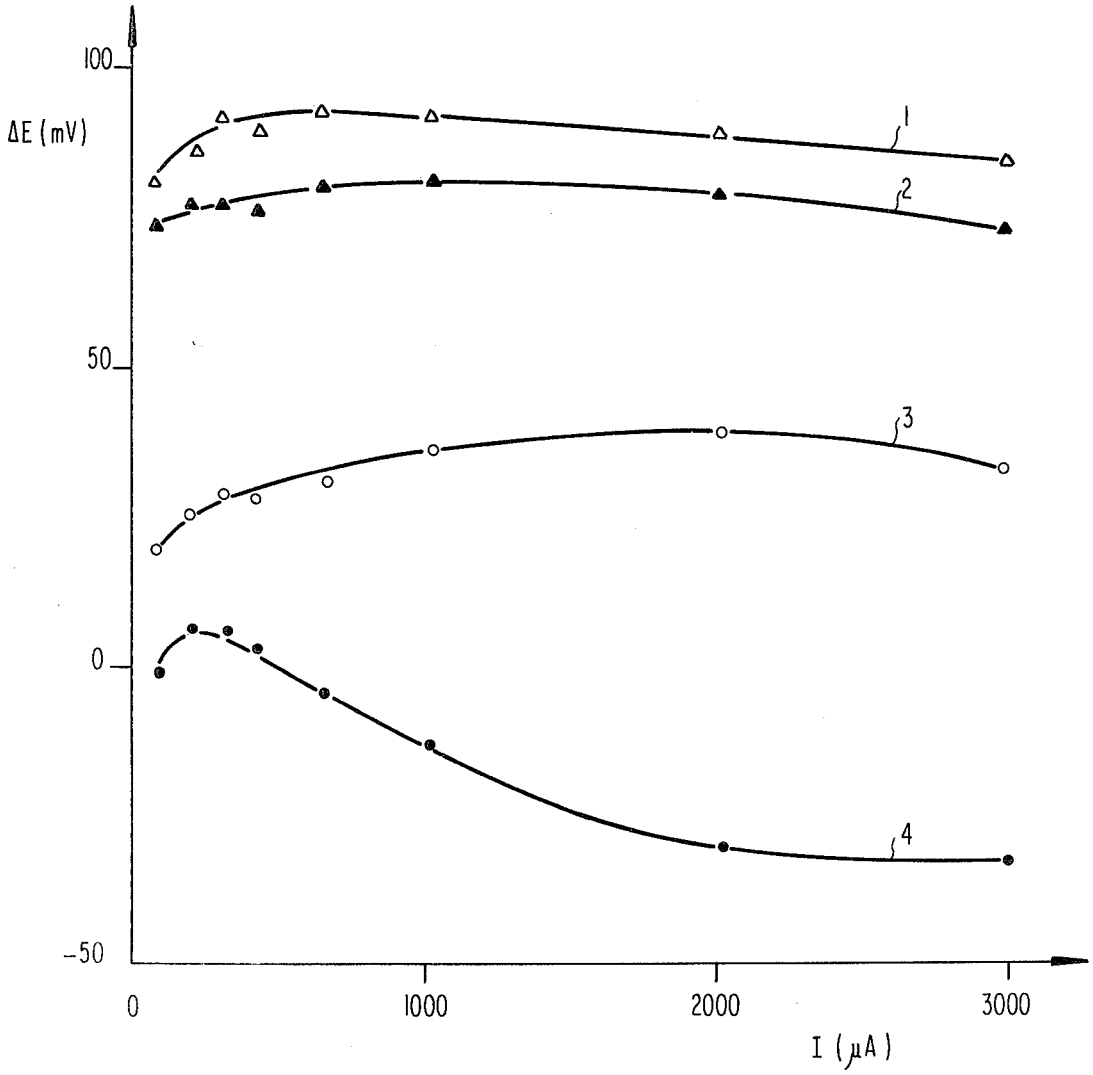
Figure 2:
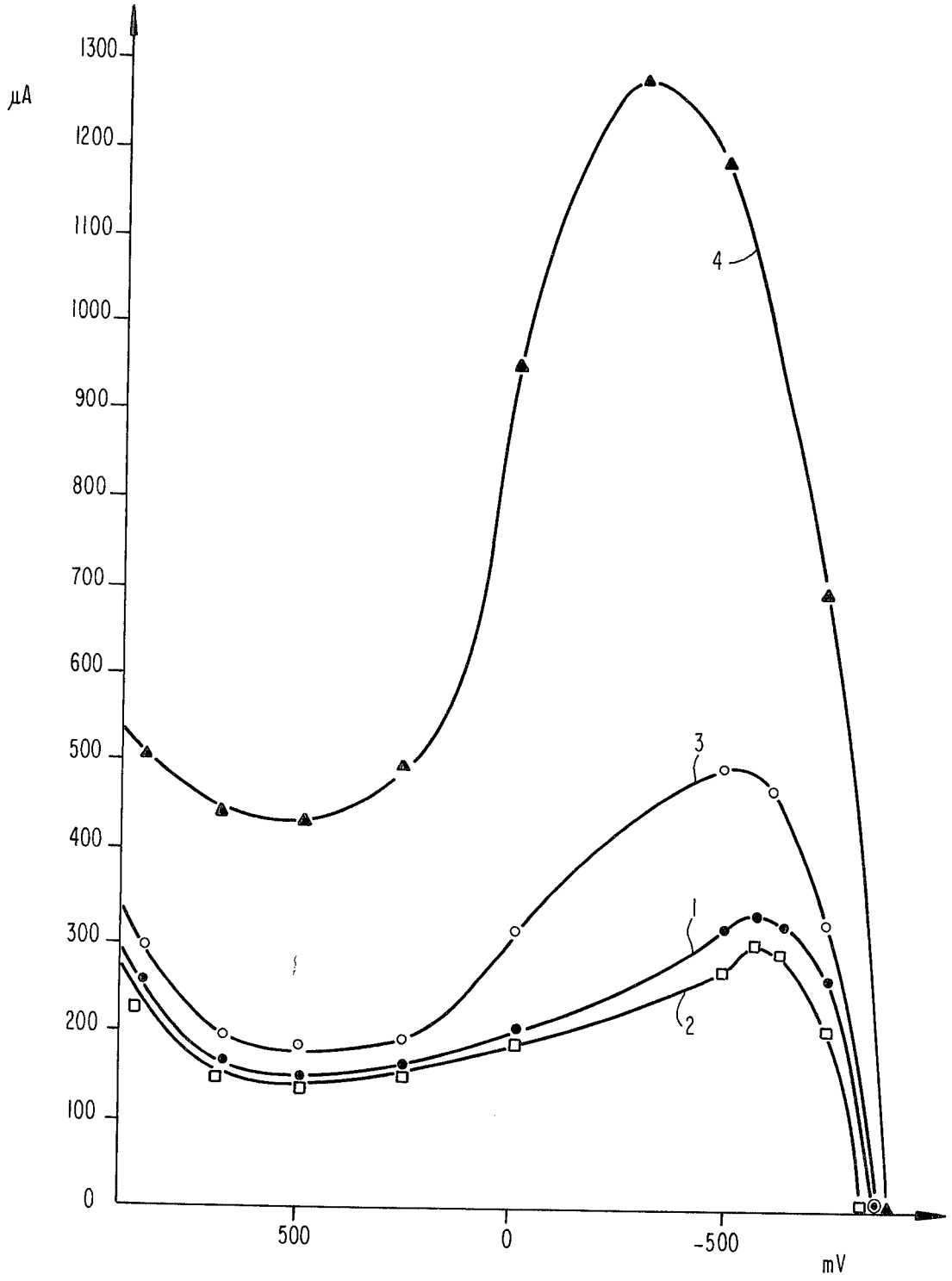

Other objects, features and advantages of the present invention will become apparent from a consideration of the following description, taken in connection with the accompanying drawings, in which:

FIG. 1 is a set of curves comparing the weathering characteristics of steel according to the present invention with known steels; and FIG. 2 is a set of curves comparing the present invention with known weathering steels as to the degree of protection afforded by the first layers of the protective oxidized coating.

According to the present invention, in a steel having the composition C 0.05 - 0.15, Mn 0.5 - 1.5, Cu 0.2 - 0.5, Al 0.2 - 0.5, Si 0.1 - 0.8, Cr 0.5 - 1.5, S up to 0.02, P up to 0.04, Nb up to 0.020, N up to 0.010, Mo up to 0.15, Ti up to 0.1, balance essentially iron, the weathering characteristics and the toughness are found to be remarkably and unforeseeably improved when the manganese, copper, chromium, aluminum and niobium contents have the following relationship:

$2.6(Mn\%) + 3.2(Cu\%) + 41.6(Nb\%) + 1.3(Cr\%/Al\%) = 7.4$ to 10.1 the value of Cr%/Al% being 2 to 5, preferably 3 to 4, and at the same time the ratio of the weight percent of chromium to aluminum is from 2 to 5, preferably frp, 3 to 4.

Steels produced according to the present invention, in addition to having excellent weathering characteristics and toughness, also have a more pleasing coloration than do known weathering steels after exposure to the weather and stabilization of the protective oxide layer.

To enable those skilled in this art to practice the invention, the following non-limitative examples are given, solely for the purpose of illustration:

EXAMPLE 1

A steel of the following composition by weight: C 0.078%, Si 0.24%, Mn 1.0%, S 0.012%, P 0.038%, Cr 0.78%, Al 0.25%, Cu 0.40%, N 0.009%, Mo 0.05%, balance essentially iron, in the as-rolled condition (thickness 15 mm) has the following mechanical properties:

| | | |
|---|---|---|
| | $R_m$ | 53 kgf/mm$^2$ |
| | $R_s$ | 36 kgf/mm$^2$ |
| | $A_5$% | 27 |

Charpy-V impact properties, according to UNI standards 4713 and 4714:

| | | |
|---|---|---|
| | −40° C | 9 kgf m/cm$^2$ |
| | −20° C | 12 kgf m/cm$^2$ |
| | +20° C | 20 kgf m/cm$^2$ |
| Transition temperature: | | −50° C |

In the bend test, performed according to UNI standard 564, with a 180° block-bend the material showed no cracking.

EXAMPLE 2

A steel of the following composition: C 0.075%, Si 0.30%, Mn 1.3%, S 0.01%, P 0.04%, Cr 0.75%, Al 0.25%, Cu 0.25%, Nb 0.020%, N 0.01%, balance essentially iron, in the as-rolled condition (thickness 15 mm), has the following mechanical properties:

| | | |
|---|---|---|
| | $R_m$ | 59 kgf/mm$^2$ |
| | $R_s$ | 40 kgf/mm$^2$ |
| | $A_5$% | 27 |

| | | |
|---|---|---|
| Charpy-V impact properties: | −40° C | 10 kgf m/cm$^2$ |
| | −20° C | 14 kgf m/cm$^2$ |
| | +20° C | 22 kgf m/cm$^2$ |
| Transition temperature: | −50° C | |

Bend test (see Example 1): Non-cracking in the bend zone.

The weathering characteristics of the steels described in Examples 1 and 2 were compared, using an accelerated method, with those of a plain carbon steel known as "Fe 42" and of the steel known by the trade-name "CORTEN". The method used consists in subjecting a disc of the test material having 3 $cm^2$ of exposed surface, polished and degreased, to a potentiodynamic treatment in an aqueous 0.1 M solution of $Na_2SO_4$. The test pieces are then subjected to anodization with currents of 10 $\mu A/cm^2$ in the same solution, following which their potentiodynamic behavior is again determined.

Finally the difference $\Delta E$, in mV, is calculated between the polarized voltages as a function of the current values in $\mu A$ on the two potentiodynamic curves. It has been found, by means of comparison with weather exposed tests, that the greater (more positive) is this difference $\Delta E$, the better are the weathering characteristics of the steel.

FIG. 1 shows the comparison between the two steels described in the Examples (Curve 1 for Example 1, Curve 2 for Example 2), the steel known as CORTEN-A (Curve 3) and the carbon steel Fe 42 (Curve 4). As will be seen, the weathering characteristics of the steels according to the present invention are clearly superior to those of CORTEN-A. In practical terms, it may be said that the compactness and the adherence of the oxide layer on the steels according to the present invention are at least four times greater. Further evidence of the better characteristics of the oxidation layer in the steels of Examples 1 and 2 with respect to those formed on CORTEN-A and on "Fe 42" carbon steel was obtained by weather exposure tests in an industrial environment.

On samples of plate, exposed for six months, the anodic polarization behavior in 0.1 M $Na_2SO_4$ was determined, so as to evaluate the degree of protection afforded by the first layers of the atmospheric patina. The data relating to this experiment are shown in the graph of FIG. 2, in which is shown the comparison between the steels according to the present invention (Curve 1 for Example 1 and Curve 2 for Example 2), the steel CORTEN-A (Curve 3) and the carbon steel Fe 42 (Curve 4). From FIG. 2, in which the data in mV are referred to a mercurous sulphate electrode, it may be seen how the shielding effect of the patina on the dissolution of iron, which is inversely proportional to the amplitude of the anodic peak, is smallest for the Fe 42, greater for CORTEN-A, and reaches a maximum for the steels 1 and 2.

This means that not only do the steels according to the present invention show more pronounced self-protection characteristics than do existing atmospheric corrosion-resistant steels, but also they develop more rapidly a stable, protective patina.

From a consideration of the foregoing disclosure, therefore, it will be evident that all of the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

Having described our invention, we claim:

1. A weathering steel consisting essentially of the following percent composition by weight:

C 0.05 – 0.15
Mn 0.5 – 1.5
Cu 0.2 – 0.5
Al 0.2 – 0.5
Si 0.0 – 0.8
Cr 0.1 – 1.5
S up to 0.02
P up to 0.04
Nb up to 0.020
N up to 0.010
Mo up to 0.15
Ti up to 0.1 balance essentially iron, the manganese, copper, chromium, aluminum and niobium having the following weight relationship: $2.6(Mn\%) + 3.2(Cu\%) + 41.6(Nb\%) + 1.3(Cr\%/Al\%) = 7.4$ to 10.1 the weight ratio of chromium to aluminum being from 2 to 5.

2. A weathering steel as claimed in claim 1, in which said weight ratio of chromium to aluminum is from 3 to 4.

* * * * *